US005388740A

United States Patent [19]

Garland

[11] Patent Number: 5,388,740

[45] Date of Patent: Feb. 14, 1995

[54] TOOL HOLDER FOR FISHERMEN AND TRADESMEN

[76] Inventor: Gordon D. Garland, 283 Arlington Avenue, Toronto, Ontario M6C 2Z8, Canada

[21] Appl. No.: 931,358

[22] Filed: Aug. 18, 1992

[51] Int. Cl.[6] ..... A45F 5/00

[52] U.S. Cl. ..... 224/253; 224/242; 224/904; 224/907; D3/220; D3/228; D3/230

[58] Field of Search ..... D3/38, 102, 210, 215, D3/220, 228, 230; 30/151, 143, 296.1, 298.4; 224/224, 226, 228, 242, 243, 245, 246, 253; 2/250

[56] References Cited

U.S. PATENT DOCUMENTS

| | | | |
|---|---|---|---|
| D. 281,896 | 12/1985 | DeMayo | D3/102 |
| 1,088,406 | 2/1914 | Davis | 224/246 |
| 1,384,669 | 7/1921 | Luttmer | 2/250 |
| 2,387,900 | 10/1945 | Hartwell | 224/197 |
| 2,500,525 | 3/1950 | De Buigne | 224/232 |
| 2,664,231 | 12/1953 | La Mantia | 224/247 |
| 2,753,094 | 7/1956 | Haney, Jr. | 224/197 |
| 2,783,536 | 3/1957 | McQueary | 224/245 X |
| 2,859,516 | 11/1958 | McQueary | 224/253 X |
| 3,516,584 | 6/1970 | Fabyan | 224/245 |
| 3,516,585 | 6/1970 | Inwood | 224/151 |
| 3,955,724 | 3/1976 | Perkins | 224/243 |
| 4,485,947 | 12/1984 | Cook | 224/243 |
| 4,496,088 | 1/1985 | Tuthill | 224/253 |
| 4,750,655 | 6/1988 | Barry | 224/243 |
| 4,790,463 | 12/1988 | Hansen | 224/253 |
| 4,940,173 | 7/1990 | Jacober | 224/151 |
| 5,004,136 | 4/1991 | Leath | 224/253 |

FOREIGN PATENT DOCUMENTS

| | | | |
|---|---|---|---|
| 0188999 | 4/1937 | Switzerland | 224/226 |

*Primary Examiner*—J. Casimer Jacyna

[57] ABSTRACT

The present invention provides for a tool holder for use by fishermen, handymen and the like. The tool holder comprises a holster portion having a pocket of a size for holding a tool, the pocket being formed from a front and base connected together along the sides thereof and having an open top. The tool holder includes a belt loop portion for attaching the holder to the belt of a user, the belt loop portion being attached to the holster portion through a movable connection. The holster portion has a closure tongue attached to the front near the top opening and has one part of a two part releasable securing means attached thereto, the second part of the two part releasable securing means being attached to the base. The closure tongue is movable between an open position falling away from the holster to allow free access to the pocket and a closed position with the tongue being centrally located and protected by the portion of the tool projecting from the pocket.

9 Claims, 1 Drawing Sheet

TOOL HOLDER FOR FISHERMEN AND TRADESMEN

FIELD OF THE INVENTION

The present invention relates to a tool holder for use by fishermen, tradesmen and homeowners. In particular, the invention relates to a pliers holder for use by fishermen, tradesmen and homeowners which allows for secure carrying of pliers while not restricting freedom of movement of the user.

BACKGROUND OF THE INVENTION

Holders and holsters for tools such as pliers, wrenches, knives, etc., have been known for a number of years. Such holders or holsters generally have a pocket or other means for holding the tool and a loop or other means for attaching the holder or holster to a belt. One example of such a holder is found in U.S. Pat. No. 2,664,321. Such holders may be provided with closure means to aid in retaining the tool in the holder such as that for example shown in U.S. Pat. No. 1,088,406. Some such holders may also be provided with various moveable means for allowing for movement of the holder such as for example shown in U.S. Pat. No. 2,387,900 where a sheath is mounted pivotally on a supporting member. However, such known examples of holders do present some difficulties for the user. Holders typically made of leather or other soft material may be too flexible and the holder may bend when the tool is removed from the pocket thereby interfering with the ease of removal of the tool from the pocket. Typical moveable attachments generally do not provide for the flexibility of movement which may be required so that the holder does not interfere with the user's freedom of movement when bending, squatting, sitting or moving about in brush or in a boat or other vessel. In other cases, holders may be of one piece design and too rigid, either with or without the tool inserted, resulting in interference with the movement of the wearer. Additionally, traditional closure means utilized with such holders generally have a fixed attachment to the holder base and a detachable closure on the sheath such that they may be inadvertently opened should the closure means catch on projecting objects. This would be particularly problematic if the holder were to be used by fishermen where the closure means could catch on branches or other projecting objects as the fisherman were walking through dense bush.

SUMMARY OF THE INVENTION

In one aspect, the present invention provides for a tool holder for use by fishermen, handymen and the like. The tool holder comprises a holster portion having a pocket of a size for holding a tool, the pocket being formed from a front and base connected together along the sides thereof and having an open top. The tool holder includes a belt loop portion for attaching the holder to the belt of a user, the belt loop portion being attached to the holster portion through a movable connection. The holster portion has a closure tongue attached to the front near the top opening and has one part of a two part releasable securing means attached thereto, the second part of the two part releasable securing means being attached to the base. The closure tongue is movable between an open position falling away from the holster to allow free access to the pocket and a closed position with the tongue being centrally located and protected by the portion of the tool projecting from the pocket.

In another aspect of the invention there is provided a pliers holder comprising a forward pocket of a size for holding a pair of pliers attached to a base. A closure tongue is attached to the front of the pocket near the top and has one part of a two part releasable securing means attached thereto, the second part of the two part releasable securing means being attached to the base. The closure tongue is movable between an open position falling away from the holster to allow free access to the pocket and a closed position with the tongue being centrally located between the handles of a pliers and protected thereby.

In yet another aspect of the invention there is provided a tool holder comprising a holster portion having a pocket of a size for holding a tool, the pocket being formed from a front and base connected together along the sides thereof and having an open top. The tool holder includes a belt loop portion for attaching the holder to the belt of a user, the belt loop portion being attached to the holster portion through a connecting means which provides for movement in more than one direction independently and simultaneously at one point. The connecting means allows freedom of movement of the holster thereby reducing the possibility of interference of the holster to freedom of movement of the user.

BRIEF DESCRIPTION OF THE DRAWINGS

The above as well as other advantages and features of the present invention will be described in greater detail according to a preferred embodiment of the present invention in which.

DETAILED DESCRIPTION OF THE PREFERRED EMBODIMENTS

Figure 1:
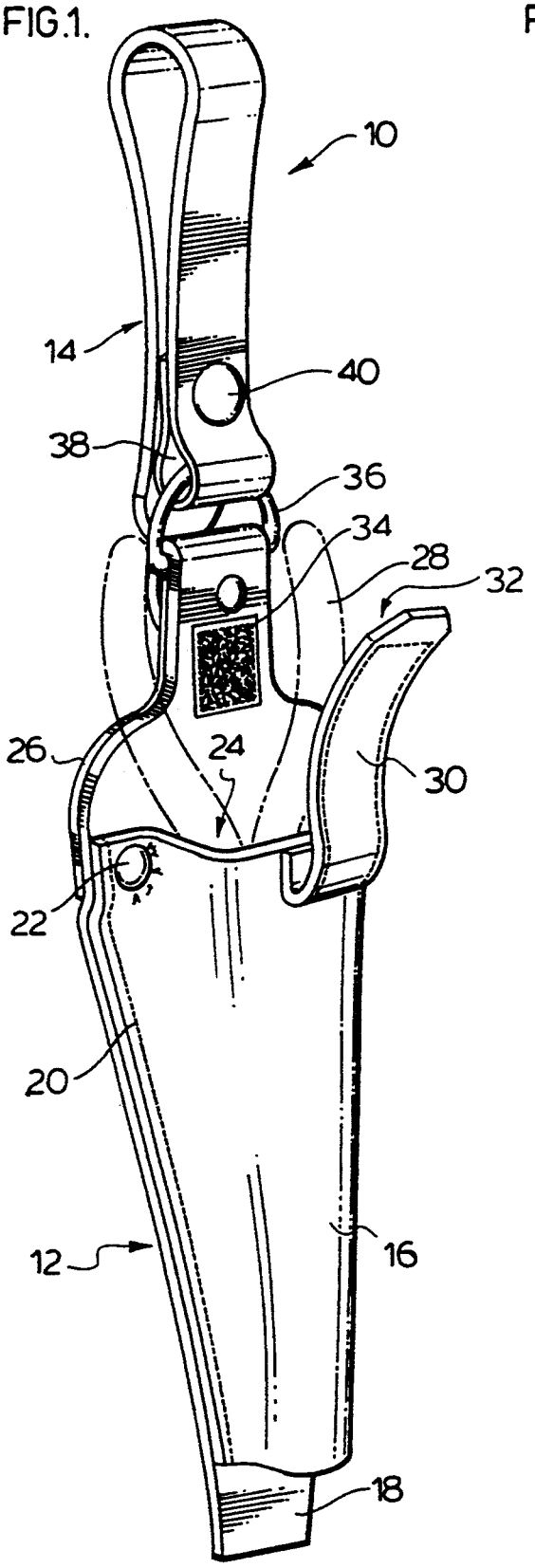
FIG. 1 is a perspective view illustrating a preferred embodiment of the present invention.
Figure 2:
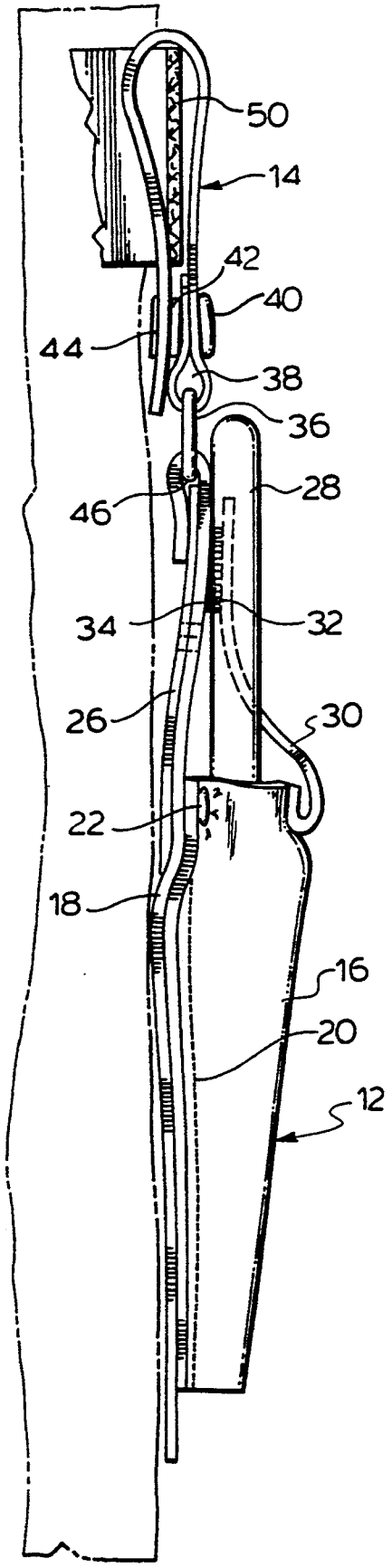
FIG. 2 is a side view of the embodiment of FIG. 1 attached to a belt of a user.

A preferred embodiment of the tool holder of the present application adapted for use with pliers is shown in FIGS. 1 and 2 generally indicated at 10. The holder comprises a holster portion 12 and a belt loop portion 14. The holster portion 12 has a front 16 and a base 18 attached together along the sides to form a pocket 24. Preferably the front 16 and a base 18 are formed of two pieces of leather, stitched together along the sides thereof by stitching 20. More preferably, in order to provide for reinforcement at the stress points, namely the corners at the top of the pocket 24, the stress points are reinforced by the use of rivets 22. The pocket 24 has an open top and preferably also has an open bottom. The pocket 24 is also preferably shaped to follow generally the contours of the tool for which the holder is designed. Thus for a pliers holder, the pocket 24 is shaped to follow the general shape of the head and grasping handle of the pliers. More preferably, the pocket is sized to accommodate a range of sizes of pliers such as 5 inch to 8 inch long nosed pliers, 5 to 6 inch straight surgical forceps, 5 inch curved surgical forceps and a wide range of specialty pliers including needle nosed pliers, chain nosed pliers, diagonal pliers, side cutting pliers and electronic pliers.

The holster portion is provided with a tongue closure 30 attached at one end thereof to the front 16 of the holster. The other end of the tongue closure 30 is provided with a grasping end and one part of a two part complementary releasable securing means 32, the second part of the two part releasable securing means 34 being attached to the base 18 of the holster above the pocket 24. The two-part releasable securing means could be a typical male-female snap arrangement. However, for ease of use the two-part securing means is preferably a fabric loop 32 and hook 34 system such as that sold under the trade-mark VELCRO. By attaching the closure tongue 30 permanently to the front 16 and providing for the releasable securing means to attach to the base 18 above the pocket 24, the closure tongue 30 falls away from the open top of the pocket 24 when the tongue is in its open position and therefore the tongue does not interfere with either easy insertion of an instrument into the holder or easy extraction of an instrument from the holder. The positioning of the loop portion 32 of the velcro on the tongue 30 and the hook portion 34 on the base 12 substantially reduces the possibility of the hook side catching on foreign material. The free end of the tongue 30 when in the closed position is centrally located between the handles of a pliers 28 and protected from coming into contact with projecting objects and thus inadvertently opening.

The holster portion 12 when constructed of a soft material such as leather, is preferably provided with a stiffening means 26 secured to the upper base 18 of the holster portion 12. The stiffening means 26 reinforces the upper base 18 of the holster 12 making it stronger and more rigid thereby preventing it from folding under when heavier and larger pliers are extracted from the pocket 24. In order to provide for durability and weather resistance, the stiffening means is preferably a durable, crack-resistant plastic such as for example polyolefin.

The belt loop portion 14 is connected to the holster 12 through a connecting means which provides for movement in more than one direction indepentantly and simultaneously at one point. The connecting means allows freedom of movement of the holster thereby reducing the possibility of interference of the holster to freedom of movement of the user. Preferably, the connecting means between the holster 12 and belt loop 14 is provided by a D ring 36 connecting the two portions together. The belt loop 14 is permanently attached to the semi circular side of the D-ring 36 by means of a much smaller loop 38 which is created by bending the belt loop material under the semi circular side of the D-ring 36 and permanently closing the small loop 38 with a dome rivet 40 so that the smaller loop 38 is of sufficient size to permit the semi circular side of the D-ring 36 to move freely in two directions, horizontally along the length of the circular side of the D-ring 36 and laterally across the width of the D-ring material and at right angles to the horizontal plane. Thus, the belt loop 14 and in particular, the smaller loop 38, act as a pivot means allowing the circular side of the D-ring 36 to pivot, swing, rotate and/or swivel in two directions either independently or simultaneously. The straight side of the D-ring 36 attached to the holster by means of a second loop 46 also allows for the holster to swing about the straight portion at right angles to the D-ring 36. The belt loop 14 is preferably provided with a releasable securing means at the bottom thereof so that the holder 10 can be attached to a belt 50 without the wearer having to remove the belt 50 to attach or detach the tool holder 10. The belt loop 14 is secured to the belt 50 by means of a two part connection system such as a female snap connector 42 on the back side of both the rivet 40 and the smaller loop 38 and a male snap connector 44 at the back inside of the belt loop 14 closest to the wearer permitting installation and removal of the belt loop without removal of the belt 50 and without permitting the back strip of the loop 14 to interfere with the movement of the D-ring 36 or extraction of the holster's contents. The releasable belt loop 14 is preferably provided with a grasping end at the back to permit fast separation of the snap fasteners 42 and 44.

The holster 12 is preferably constructed of a soft material and owing to the stresses to which it will be subjected particularly from weather and wetness, more preferably the material is a leather such as a 5 ½ ounce chromium tan leather. This leather provides the holster and fastening tab with strength, the ability to withstand repeated wetting and adverse weather conditions without cracking and non-shrink, non-stretch properties. The belt loop 14 similarly is made from a soft yet stiffer material such as 7.5 to 8.5 ounce vegetable tan English bridle leather. This leather has strength, workability and the ability to withstand adverse weather conditions and provides the belt loop 14 with its required strength and stiffness. To provide for the ability to expand and contract with the leather when exposed to the elements, the thread used for the stitching 20 is preferably a linen thread. In order to reduce the possibility of the metal portions such as for example the D-ring 36 and rivets 22 becoming rusty upon exposure to the elements, these materials are preferably constructed of brass or similar such relatively weather resistant metals.

The present invention provides for a holder that allows freedom of movement for the wearer of the holder accomplished through the use of the movable connection, in particular the D-ring, between the belt loop and the holster. The holder fits a wide range of pliers and forceps used by fishermen or anglers, tradesmen and home handymen accomplished through designing the holster to accommodate 5 to 8 inch long nosed pliers, 5 to 6 inch straight surgical forceps, 5 inch curved surgical forceps. By providing the holster with a narrow open bottom ease of drainage of water from the holster should the holster be inadvertently submerged in the water is permitted. The present invention also provides for a holder having a quick opening closure that secures the pliers but does not interfere with extraction or insertion of the pliers or forceps when the closure is in the opened position. This is accomplished through the use of closure tongue attached to the holster front and the releasable securing means releasably securing the tongue to the holster base. The leather and stitching of the preferred embodiment of the holder resists cracking and will continue to retain its characteristics even under wet weather conditions. The holder may be easily used by anglers, trades people and home handymen to carry a wide range of pliers or forceps so that they do not interfere with the wearer's movements, can be easily located, accessed and returned to a normal location. The holder does not restrict the movements of a user whether walking, wading, bending or sitting in a boat and the stiffening means or backing aids in the easy insertion and extraction of the pliers without the holder bending or in other ways interfering with the extraction.

Although various preferred embodiments of the present invention have been described herein in detail, it will be appreciated by those skilled in the art that variations may be made thereto without departing from the spirit of the invention or the scope of the appended claims.

The embodiments of the invention in which an exclusive property or privilege is claimed are defined as follows:

1. A tool holder for use by fishermen, handymen and the like comprising:

a holster portion having a pocket of a size for holding a tool, the pocket being formed from a front and base connected together along the sides thereof and having an open top, the base in at least the area above the pocket being of a stiffness to substantially reduce bending or folding when a tool is removed from the pocket a belt loop portion for attaching the holder to the belt of a user, the belt loop portion being attached to the holster portion through a movable connection which allows the holster portion movement about two perpendicular axes simultaneously, a closure tongue being attached to the front near the top opening and having one part of a two part releasable securing means attached thereto, the second part of the two part releasable securing means being attached to the base above the pocket, the two part releasable securing means releasably securing the closure tongue to the base, the closure tongue being movable between an open position falling away from the holster to allow free access to the pocket and a closed position with the tongue being centrally located and protected by the portion of the tool projecting from the pocket.

2. A tool holder as claimed in claim I wherein the holder is adapted for holding pliers and the closure tongue in the closed position is centrally located between the handles of the pliers and protected thereby.

3. A pliers holder as claimed in claim 2 wherein the sides of the front and base forming the pocket taper from the top to an open bottom.

4. A pliers holder as claimed in claim 2 wherein the holster portion is constructed of a soft material and the base near the top is provided with stiffening means to provide the stiffness to substantially reduce bending or folding when a pliers is inserted or removed from the pocket.

5. A pliers holder as claimed in claim 4 wherein the stiffening means is provided by a piece of polyolefin plastic attached to the base.

6. A pliers holder as claimed in claim 2 wherein the movable connection between the holster and belt loop portions is provided by a D ring connecting the two portions together, the connection allowing freedom of movement of the holster thereby reducing the possibility of interference of the holster to freedom of movement of the user.

7. A pliers holder as claimed in claim 2 wherein the releasable securing means is provided by a fabric hook and loop securing means allowing easy opening of the closure tongue with finger pressure to allow ease of insertion and removal of pliers from the holder.

8. A pliers holder comprising a forward pocket of a size for holding a pair of pliers attached to a base, a closure tongue attached at one end to the front of the pocket near the top, the closure tongue having a front and back, the front of the closure tongue being in contact with the front of the pocket at the point of attachment thereto, the closure tongue further including one part of a two part releasable securing means attached to the back near a second end, the second part of the two part releasable securing means being attached to the base above the pocket, the two part releasable securing means releasably securing the closure tongue to the base, the closure tongue being movable between an open position falling away from the holster to allow free access to the pocket and a closed position with the tongue being centrally located between the handles of a pliers and protected thereby.

9. A pliers holder as claimed in claim 8 wherein the releasable securing means is provided by a fabric hook and loop securing means allowing easy opening of the closure tongue with finger pressure to allow ease of insertion and removal of pliers from the holder.

* * * * *